US011624217B2

(12) United States Patent
Krishnan et al.

(10) Patent No.: US 11,624,217 B2
(45) Date of Patent: Apr. 11, 2023

(54) FRONT TRUNK LATCH ENTRAPMENT RELEASE SYSTEM

(71) Applicant: Ford Global Technologies, LLC, Dearborn, MI (US)

(72) Inventors: Venkatesh Krishnan, Wayne, MI (US); Thomas Michael Herline, Canton, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 1448 days.

(21) Appl. No.: 15/880,625

(22) Filed: Jan. 26, 2018

(65) Prior Publication Data

US 2019/0234118 A1 Aug. 1, 2019

(51) Int. Cl.

| | |
|---|---|
| ***E05B 83/26*** | (2014.01) |
| ***E05B 77/54*** | (2014.01) |
| ***E05B 79/20*** | (2014.01) |
| ***E05B 83/24*** | (2014.01) |

(52) U.S. Cl.

CPC ..... *E05B 83/26* (2013.01); *E05B 77/54* (2013.01); *E05B 79/20* (2013.01); *E05B 83/24* (2013.01); *Y10S 292/14* (2013.01); *Y10S 292/42* (2013.01); *Y10S 292/65* (2013.01); *Y10T 292/1047* (2015.04); *Y10T 292/57* (2015.04)

(58) Field of Classification Search

CPC ..... E05B 83/16; E05B 83/26; E05B 77/54; E05B 79/20; E05B 83/24; E05B 77/08; E05B 83/18; E05B 83/22; Y10T 292/1047; Y10T 292/57; Y10T 292/1082; Y10T 292/1092; Y10S 292/14; Y10S 292/30; Y10S 292/23; Y10S 292/65; Y10S 292/42

See application file for complete search history.

(56) References Cited

U.S. PATENT DOCUMENTS

| | | | | |
|---|---|---|---|---|
| 2,136,948 A * | 11/1938 | Nyhus | B62D 25/12 292/209 |
| 2,146,186 A * | 2/1939 | Hynes | E05B 83/247 292/215 |
| 2,188,333 A * | 1/1940 | Claud-Mantle | E05B 83/247 292/214 |

(Continued)

FOREIGN PATENT DOCUMENTS

| | | |
|---|---|---|
| DE | 102012212542 A1 | 2/2013 |
| EP | 1039077 A3 | 1/2005 |
| WO | 99/04119 A1 | 1/1999 |

OTHER PUBLICATIONS 2013-2016 Boxster—Manual, p. 26, http://www.porscheownersmanuals.com/2014-boxster-manual/7/26/Function.

*Primary Examiner* — Christine M Mills

*Assistant Examiner* — Faria F Ahmad

(74) *Attorney, Agent, or Firm* — Vichit Chea; Carlson, Gaskey & Olds, P.C.

(57) ABSTRACT

A latch release system for a vehicle includes a primary and a secondary latch securing a front hood. An emergency handle within a compartment is covered by the front hood, linked to the primary latch and movable to actuate a switch. An actuator is arranged to release the secondary latch. A controller is configured to trigger the actuator to release the secondary latch responsive to actuation of the switch. An emergency latch release system for front compartment of a motor vehicle and a method are also disclosed.

16 Claims, 4 Drawing Sheets

(56) References Cited

U.S. PATENT DOCUMENTS 2,809,064 A * 10/1957 Dlugatch ..... E05B 83/24 292/226
4,756,562 A * 7/1988 Foster ..... E05B 83/24 292/28
4,961,601 A * 10/1990 Lindholm ..... E05B 83/16 292/216
4,991,884 A * 2/1991 Cairns ..... E05B 83/24 292/28
5,738,393 A * 4/1998 Chao ..... E05B 83/24 292/216
5,853,060 A * 12/1998 Chao ..... E05B 83/16 180/69.2
6,018,292 A 1/2000 Penny, Jr.
6,062,615 A * 5/2000 Hunt ..... E05B 85/12 292/216
6,109,670 A * 8/2000 Tomaszewski ..... E05B 83/24 292/216
6,209,933 B1 * 4/2001 Ang ..... E05B 17/10 292/336.3
6,222,442 B1 * 4/2001 Gager ..... E05B 83/16 307/10.1
6,394,511 B1 * 5/2002 Lam ..... E05B 83/16 292/336.3
6,666,483 B2 * 12/2003 Baniak ..... E05B 83/24 292/123
7,845,691 B2 * 12/2010 Sundararajan ..... E05B 77/08 292/216
8,215,683 B2 * 7/2012 Drescher ..... E05B 83/16 292/216
8,798,858 B2 * 8/2014 Zysk ..... E05B 83/26 701/36
9,205,803 B2 * 12/2015 Farooq ..... B60R 21/38
9,284,757 B2 * 3/2016 Kempel ..... E05B 83/26
9,739,078 B2 8/2017 Diehl et al.
9,950,635 B1 * 4/2018 Trego ..... B60L 53/16
10,113,340 B2 * 10/2018 Gawade ..... B60Q 1/50
10,655,367 B2 * 5/2020 Ferri ..... B60R 21/34
10,808,436 B2 * 10/2020 Cuddihy ..... E05B 81/58
10,941,593 B2 * 3/2021 Krishnan ..... E05B 79/20
11,332,027 B2 * 5/2022 Janarthanam ..... E05B 73/00
2002/0063432 A1 * 5/2002 Choi ..... E05B 83/16 292/336.3
2002/0101082 A1 * 8/2002 Schwaiger ..... E05B 83/16 292/216
2003/0122382 A1 * 7/2003 Baniak ..... E05B 83/24 292/116
2007/0246952 A1 * 10/2007 Beauchamp ..... E05B 83/24 292/216
2008/0231062 A1 * 9/2008 Konchan ..... E05B 17/106 292/336.3
2012/0032457 A1 * 2/2012 Ishikawa ..... E05B 83/26 292/336.3
2012/0161453 A1 * 6/2012 Zysk ..... E05B 83/24 292/21
2013/0049403 A1 * 2/2013 Fannon ..... E05B 83/24 296/193.11
2013/0140831 A1 * 6/2013 Kempel ..... E05B 83/26 292/3
2013/0238187 A1 * 9/2013 Zysk ..... E05B 81/56 701/36
2015/0115625 A1 * 4/2015 Park ..... E05B 83/24 292/194
2016/0168884 A1 * 6/2016 Hillgaertner ..... E05B 83/243 292/196
2016/0340941 A1 * 11/2016 Taurasi ..... E05B 77/08
2017/0101810 A1 * 4/2017 Lee ..... E05B 79/16
2019/0100945 A1 * 4/2019 Obita ..... E05B 83/24
2019/0128028 A1 * 5/2019 Herline ..... E05B 77/54
2019/0169890 A1 * 6/2019 Krishnan ..... E05B 83/26
2019/0338568 A1 * 11/2019 Klein ..... E05B 79/20

* cited by examiner

FRONT TRUNK LATCH ENTRAPMENT RELEASE SYSTEM

TECHNICAL FIELD

This disclosure relates to a latch release system for a front storage compartment that enables opening from an exterior of the vehicle.

BACKGROUND

Vehicles are increasingly utilizing alternate propulsion systems. The alternate propulsion systems may be positioned in other locations within the vehicle such that additional space in the front of the vehicle is usable for storage. The front hood of a vehicle includes a latch to secure the hood.

SUMMARY

A latch release system for a vehicle according to an exemplary aspect of the present disclosure includes, among other things, a primary and a secondary latch securing a front hood. An emergency handle within a compartment is covered by the front hood, linked to the primary latch and movable to actuate a switch. An actuator is arranged to release the secondary latch. A controller is configured to release of trigger the actuator to release the secondary latch responsive to actuation of the switch.

In a further non-limiting embodiment of the foregoing latch release system, a first handle is disposed within a cabin of the vehicle. The first handle and the emergency handle are coupled to a common first mechanical link for actuating the primary latch.

In a further non-limiting embodiment of any of the foregoing latch release systems, the common first mechanical link includes a split Bowden cable including a first end attached to the primary latch, second end attached to the first handle and a third end attached to the emergency handle.

In a further non-limiting embodiment of any of the foregoing latch release systems, a secondary handle is accessible from outside the vehicle and coupled to the secondary latch through a second mechanical link.

In a further non-limiting embodiment of any of the foregoing latch release systems, the secondary latch is releasable only by the actuation through the second mechanical link and the actuator.

In a further non-limiting embodiment of any of the foregoing latch release systems, the primary latch releases the front hood only to a partial open position and the secondary latch releases the front hood to allow complete opening of the front hood such that the front hood may be moved to a fully open position only upon release of both the primary latch and the secondary latch.

In a further non-limiting embodiment of any of the foregoing latch release systems, the controller is configured to receive information indicative of vehicle speed and responsive to actuation of the switch by the emergency handle, command the actuator to release secondary latch responsive to the vehicle speed being within a predefined threshold range.

In a further non-limiting embodiment of any of the foregoing latch release systems, controller is configured to not actuate the actuator responsive to actuation of the switch by the release handle when the vehicle speed is outside the predefined threshold range.

In a further non-limiting embodiment of any of the foregoing latch release systems, the predefined threshold range is between 0 and 3 mph (5 km/hour).

An emergency latch release system for front compartment of a motor vehicle according to an exemplary aspect of the present disclosure includes, among other things, a primary and a secondary latch securing a front hood. An emergency handle is within the front compartment that is linked to the primary latch by a first mechanical link. A switch is actuatable by the emergency handle. An actuator is commanded to actuate the switch to release the secondary latch responsive to a vehicle speed being within a predefined threshold range.

In a further non-limiting embodiment of the foregoing emergency latch release system, a controller receives information indicative of vehicle speed and in communication with the actuator to command release of the secondary latch responsive to the vehicle speed being within the predefined threshold range.

In a further non-limiting embodiment of any of the foregoing emergency latch release systems, the emergency handle is actuatable to release only the primary latch through the first mechanical link.

In a further non-limiting embodiment of any of the foregoing emergency latch release systems, the secondary latch is releasable from within the front compartment only by actuator.

In a further non-limiting embodiment of any of the foregoing emergency latch release systems, the primary latch releases the front hood only to a partial open position and the secondary latch releases the front hood to allow complete opening of the front hood such that the front hood may be moved to a fully open position only upon release of both the primary latch and the secondary latch.

A method according to another exemplary aspect of the present disclosure includes, among other things, a primary latch is coupled to an emergency handle disposed within a compartment covered by a front hood. A secondary latch is coupled to an actuator. The primary latch is released responsive to actuation of the emergency handle. The secondary latch is released responsive to actuation of the actuator prompted by switch within the compartment in response to an indication that a speed of the vehicle is below a threshold speed.

In a further non-limiting embodiment of the foregoing method, actuation of both the primary latch and the secondary latch are required to fully open the front hood.

In a further non-limiting embodiment of any of the foregoing methods, the front hood is opened to an intermediate position responsive to actuating the emergency handle and the vehicle traveling a speed above the threshold speed. The intermediate position includes release of the primary latch only.

In a further non-limiting embodiment of any of the foregoing methods, a controller receives information indicative of vehicle speed and controls actuation of the actuator to release the secondary latch and not releasing the secondary latch responsive to the controller receiving information indicative of a vehicle speed above the threshold speed.

The various features and advantages of this disclosure will become apparent to those skilled in the art from the following detailed description. The drawings that accompany the detailed description can be briefly described as follows.

DETAILED DESCRIPTION

Figure 1:
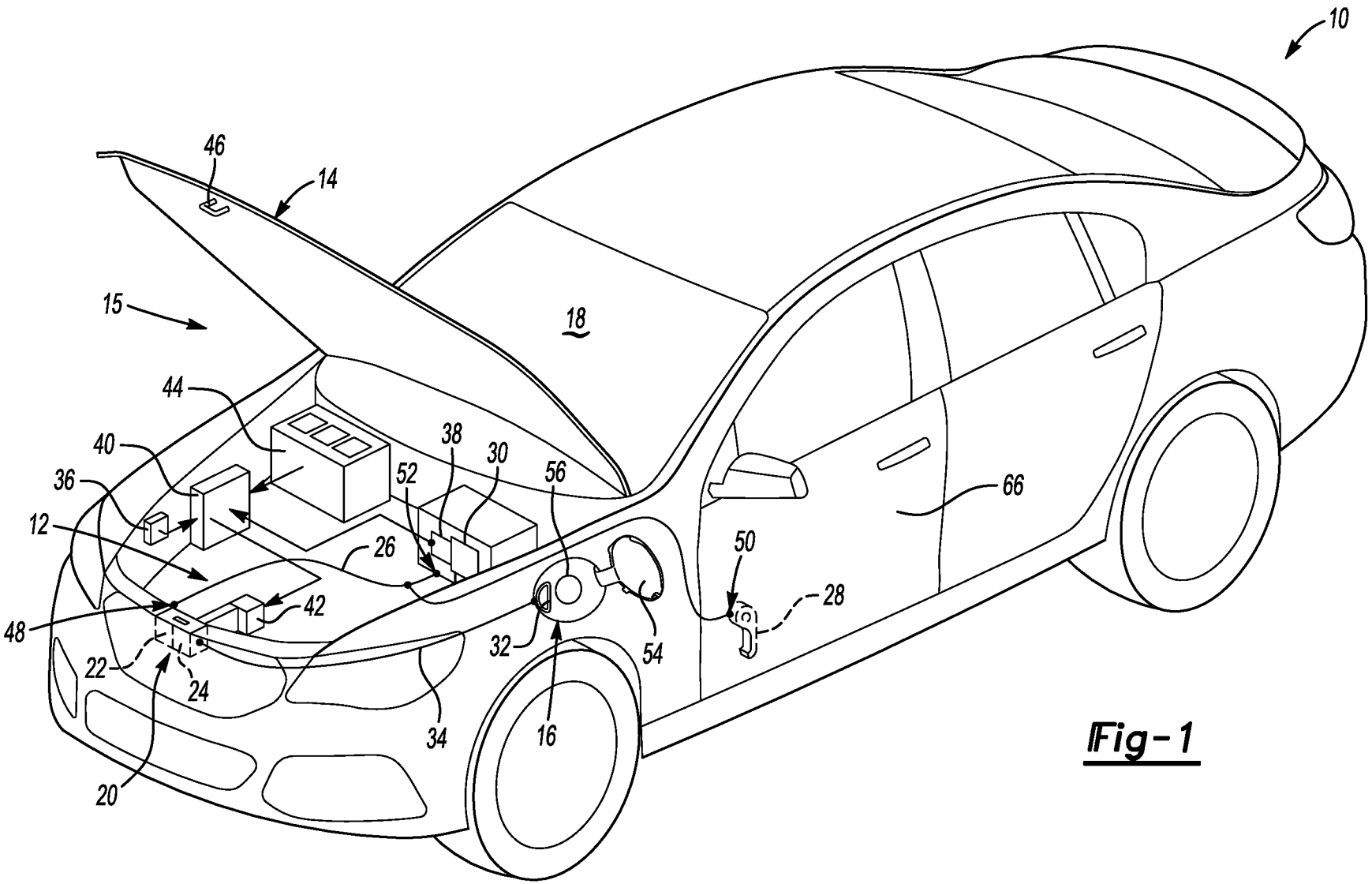
FIG. 1 is a schematic view of a vehicle including an example front hood latch release system.

Referring to FIG. 1, a vehicle 10 includes a front compartment 12 that is covered by a front hood 14. The front hood 14 includes a catch 46 that latches to a latch assembly 20. The latch assembly 20 includes a primary latch 22 and a secondary latch 24. The example front compartment 12 does not include an engine and is large enough to hold a person. The latch assembly 20 is actuatable by a first handle 28 that is disposed within a vehicle cabin 18.

Because the front compartment 12 is large enough to hold an occupant, it must be able to be released from within the compartment 12. Additionally, because the hood 14 is at a front of the vehicle, it must include a secondary latching system that cannot be actuated when the vehicle is travelling above a predefined speed.

The example latch release system 15 includes features that enable actuation of the primary latch 22 from within the vehicle compartment 12 and the vehicle cabin 18. However, release of the primary latch 22 does not allow full opening of the hood 14. Before the hood 14 can be fully opened, the secondary latch 24 must be actuated. The example hood release system 15 includes an emergency handle 30 that actuates the primary latch 22 through a cable 26 and actuates a switch 38. The switch signals a controller 40 to actuate a powered actuator to open the secondary latch 24 in response to the vehicle speed being below a threshold value.

Figure 2:
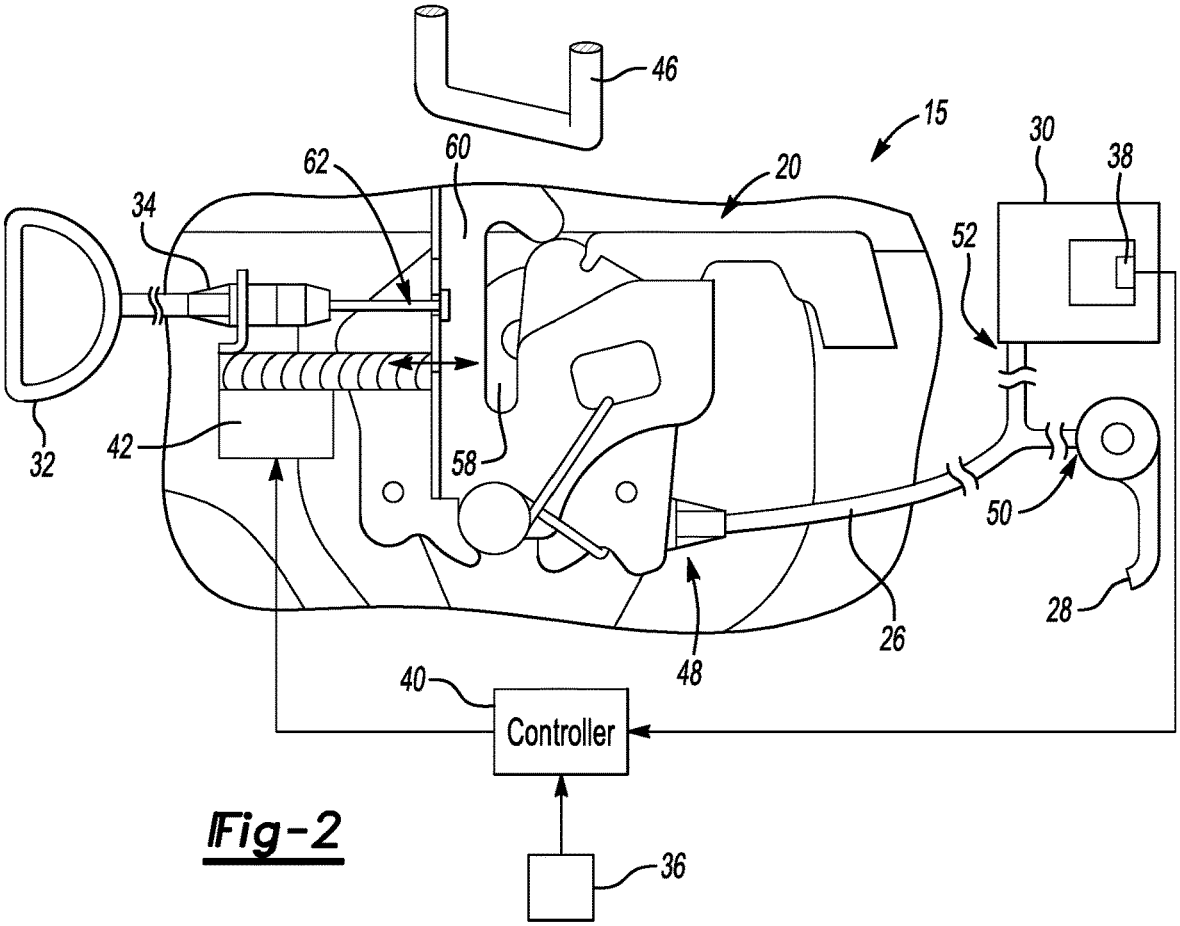
FIG. 2 is a schematic view of the example latch assembly.

Referring to FIG. 2 with continued reference to FIG. 1, the example latch assembly 20 includes a primary catch 58 and a secondary catch 60. The secondary catch 60 remains engaged to prevent full opening of the hood 14 until secondary handle 32 or the powered actuator 42 is actuated. The secondary handle 32 is only accessible from outside of the vehicle cabin 18 and the front compartment 16.

The example latch release system 15 includes the first handle 28 and the emergency handle 30 coupled to a common link 26. The common link 26 is a split Bowden cable that includes a first end 48 attached to actuate the primary catch 58. A second end 50 is attached to the first handle 28 that is disposed and accessible from within the vehicle cabin 18. A third end 52 of the cable 26 is coupled to the emergency handle 30 that is accessible from within the front compartment 12.

Upon actuation of the first handle 28 or the emergency handle 30, the primary catch 58 is released and the hood 14 will move to an initial open position. In the initial open position, the hood 14 is not openable as it is still limited in movement by the secondary catch 60. Further actuation of the first handle 28 or the emergency handle 30, does not release the secondary catch 60. Accordingly, the secondary catch 60 must be released by actuation of the second handle 32 or the actuator 42.

The example second handle 32 is disclosed as being accessible through the charging compartment 16, other locations on the vehicle accessible from outside of the vehicle cabin only could also be utilized and are within the contemplation of this disclosure. Pulling of the second handle 32, actuates the secondary latch 24 to pull the secondary catch 60 in a direction that releases it from the catch 46 to enable fully opening of the hood 14.

The example latch release system 15 is also actuated at least partially through a power actuator 42 powered through an onboard power source such as battery 44. In this example, the powered actuator 42 is coupled to the secondary latch 24 and receives signals from the controller 40 in response to actuation of the switch 38. The switch 38 is actuated in response to pulling of the emergency handle 30 within the compartment 12. Actuation of the switch 38 is caused by pulling of the emergency handle 30. The switch 38 signals the controller 40 to control the actuator 42 to release the secondary latch 24.

The controller 40 receives information indicative of vehicle speed from at least one sensor 36. The sensor 36 can be a dedicated sensor 36 of the system 15, or may be a sensor provided for other systems within the vehicle 10. The controller 40 will command operation of the actuator 42 to open the second latch 24 in response to the vehicle speed being below a predefined threshold speed. In one disclosed embodiment, the threshold speed is 3 mph (5 kph). It should be appreciated that other speed thresholds as may be desired are within the contemplation of this disclosure.

The controller 40 will in response to the speed being below the threshold speed, command the actuator 42 to open the secondary latch 24. The first pull of the emergency handle 30 also actuates the switch 38 to trigger the controller 40 to open the secondary latch 24. If the vehicle speed is determined to be above the threshold value, the controller 40 will not command actuation of the actuator 42 and the secondary catch 60 will remain engaged to prevent opening of the hood 14 to the fully open position. The hood 14 is opened to an intermediate position that can provide airflow into the compartment 12 for an occupant.

Upon reduction in vehicle speed below the threshold speed, the controller 40 can in one example embodiment automatically command actuation of the actuator 42 to open the secondary latch 24. In another example embodiment, the controller 40 may not automatically command actuation and instead require a second pull on the emergency handle 30 to actuate the switch 38 to prompt the controller 40 to command actuation to open the secondary latch 24.

Figure 3:
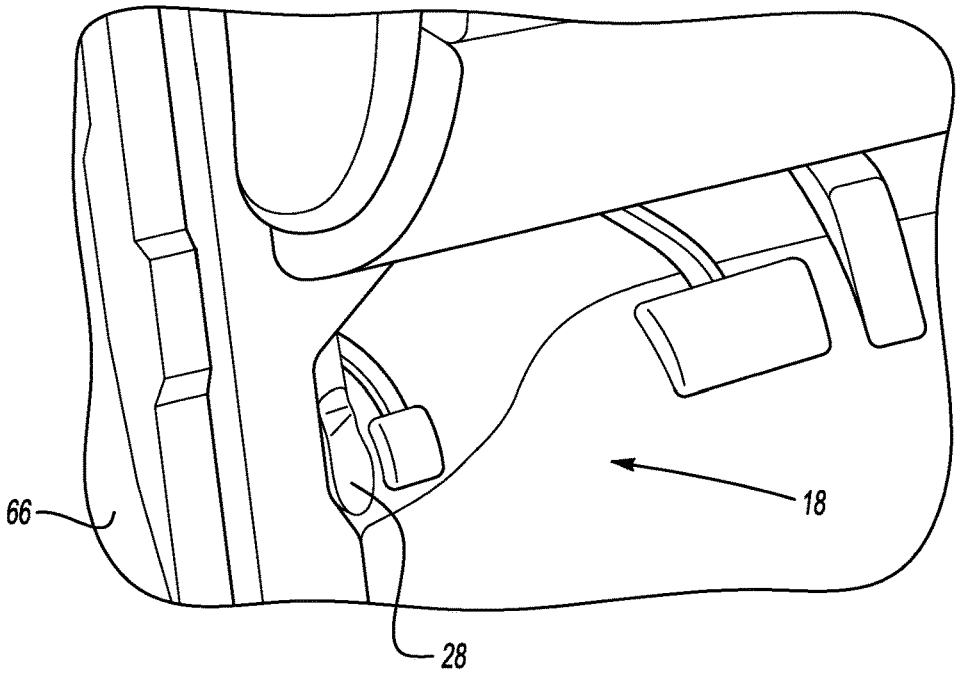
FIG. 3 is a perspective view of an interior of a vehicle cabin including a first latch release handle.
Figure 4:
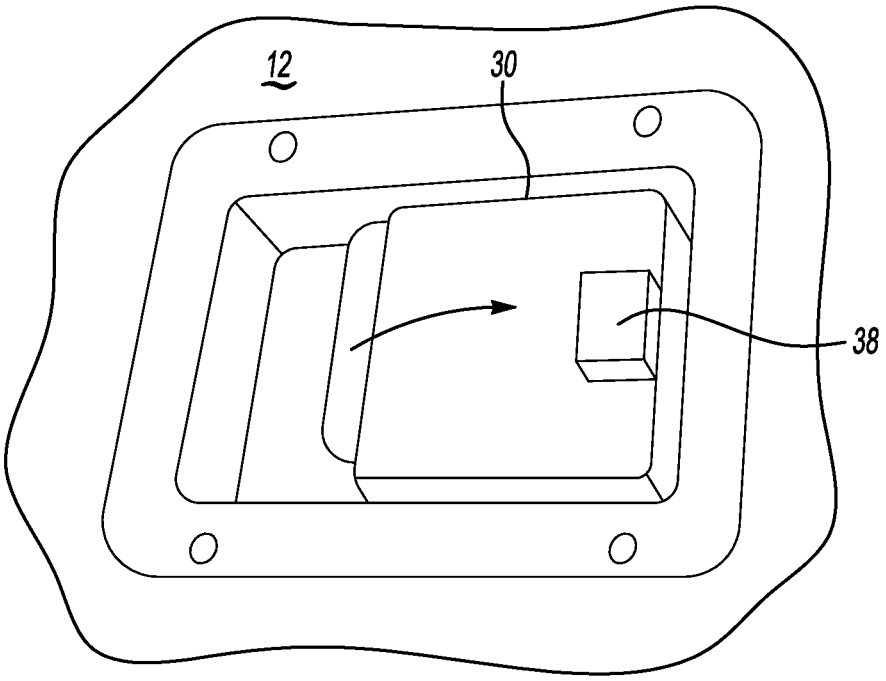
FIG. 4 is a perspective view of an emergency release handle.

Referring to FIGS. 3 and 4 with continued reference to FIG. 1, the first handle 28 is disposed within the vehicle cabin 18 in the location that is blocked when the vehicle door 66 is closed. Because the vehicle door 66 blocks actuation of the first handle 28, the handle 28 may only be actuated when the vehicle 10 is in a parked non-moving condition.

The emergency handle 30 is accessible from within the compartment 12 and may manually actuate the primary latch and cause the switch 38 to prompt the controller 40 to unlatch the secondary latch 24. The example emergency handle 30 automatically actuates the switch 38 in response to the single pull. The example switch 38 is shown schematically and may comprise any configuration and structure known that is actuated through a mechanical prompt of pulling the handle 30. Moreover, although the example switch 38 is actuated by the handle 30, a second handle or button could also be utilized to actuate the switch 38.

Figure 5:
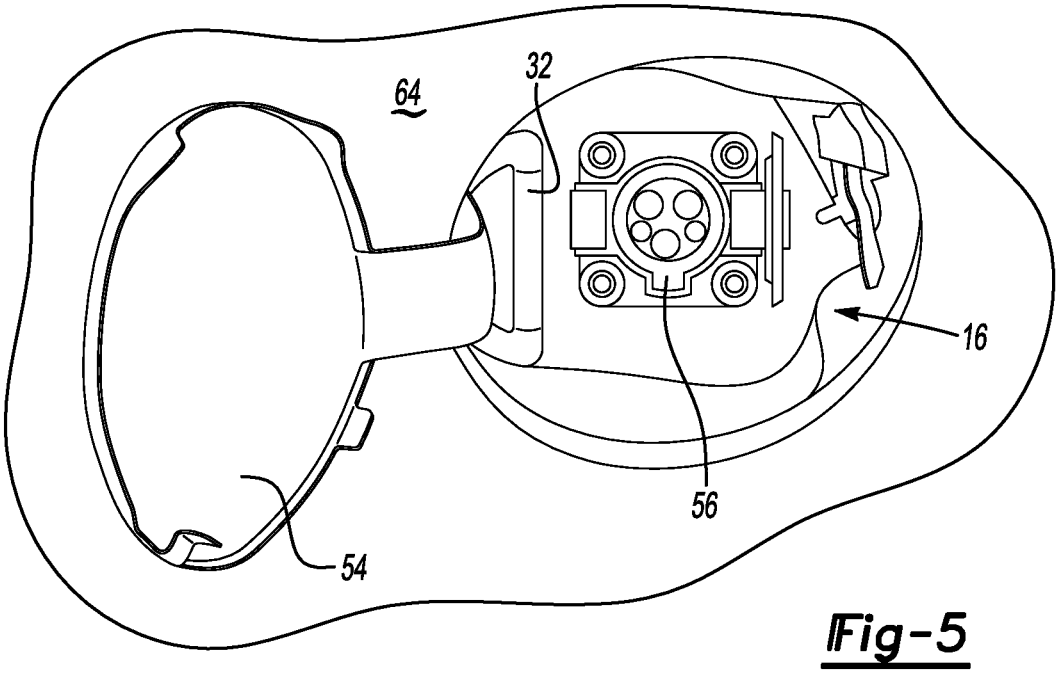
FIG. 5 is a perspective view of a closable compartment accessible from outside the vehicle cabin.

Referring to FIG. 5 with continued reference to FIG. 2, the example closable compartment 16 includes the charging port 56 and the handle 32. A hatch 54 is closable over the compartment 16. The hatch 54 may be openable from a lever within the vehicle cabin or may also be openable from an external location outside the vehicle 10. The example compartment 16 is one example of a location where the secondary handle 32 may be located. Other locations apart from the latch assembly 20 could also be utilized and are within the contemplation of this disclosure.

Figure 6:
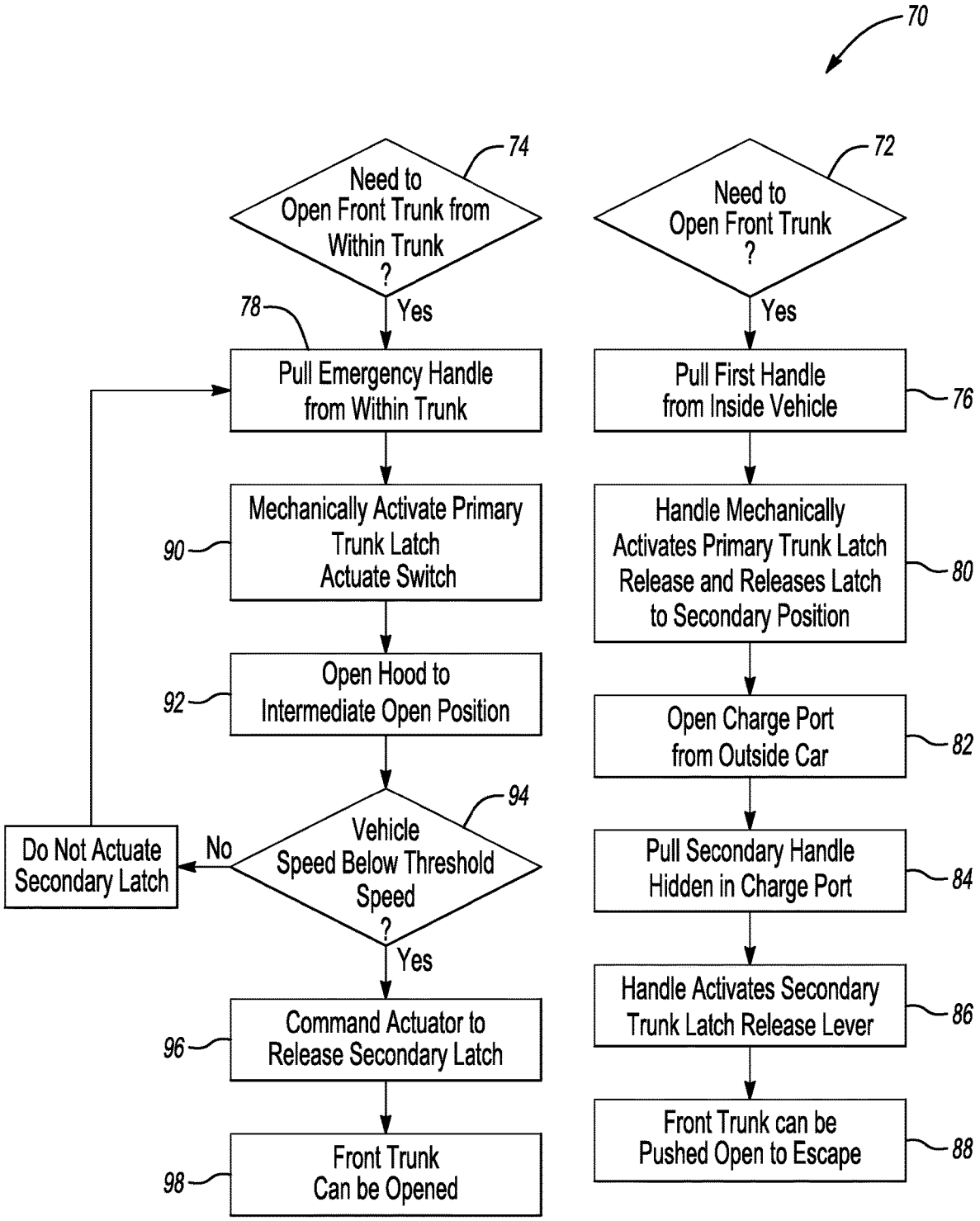
FIG. 6 is a flow diagram illustrating operation steps of the example front hood latch release system.

Referring to FIG. 6 with continued reference to FIG. 1, an example method of operating the example disclosed front hood release system is schematically illustrated at 70 and includes a first sequence of steps 72 applicable under a first condition. The example first condition includes instances when a driver or occupant of the vehicle 18 may access the vehicle cabin 18 and is not present within the front compartment 12. When it is desired to open the front hood 14, the first handle 28 is pulled from inside the vehicle 18 as is indicated at 76. The first handle 28 mechanically activates the primary latch 22 and releases the catch 46 to a position where the secondary catch 60 of the secondary latch 22 is holding the hood 14 in the initial open position as indicated at 80. The operator must then exit the vehicle, open the closable compartment 16 as is indicated at 82 and pull the secondary handle 32 that is within that compartment 16 as is indicated at 84. Pulling of the secondary handle 32 releases the secondary latch 60 enabling opening of the front hood 14 to a fully open position as indicated at 86.

If a passenger is trapped within the compartment 12 and the front trunk needs to be opened according to a second sequence of the steps shown at 74. The second sequence of steps 74 is a different process. An occupant within the front compartment 12 will pull on the emergency handle 30 at 78 to actuate the primary latch 22 and release the primary catch 58 as indicated at 90. Releasing of the primary latch 22 does not allow full opening of the front hood 14 but does move the hood 14 to the first initial open position as indicated at 92. The first open position unseals the front hood and allows airflow into the front compartment 12 through the partially open front hood 14.

Pulling of the emergency handle 30 actuates the switch 38 that prompts the controller 40 to review if conditions are present that allow opening of the front hood 14 as indicated at 94. The conditions in the disclosed embodiment are that the vehicle is traveling below the threshold speed. The controller 40 evaluates information from the speed sensor 36 and commands actuation of the actuator 42 when the vehicle speed is below the threshold value. The actuator 42 will then actuate the secondary latch 24 to move the secondary catch 60 an enable full opening of the hood 14 as indicated at 96 and 98.

If the vehicle speed is above the threshold speed, the controller 40 does not actuate the actuator 42 and the hood 14 remains in the intermediate latched position. The controller 40 is configured to prevent actuation when the vehicle speed is above the threshold speed. Once the vehicle reduces speed below the threshold speed, the controller 40 will be able to prompt actuation to open the secondary latch 24. The controller 40 in one disclosed embodiment will automatically command actuation once the speed is below the threshold speed. In such a case, an additional or second pull of the emergency handle 30 is not required. In another embodiment, the controller 40 does not automatically command actuation once the threshold speed drops below the threshold speed. In such a case, an additional or second pull of the emergency handle 30 is required.

Accordingly, the example front hood release system 15 simplifies operation and assembly by preventing opening of the hood 14 above a threshold vehicle speed.

Although the different non-limiting embodiments are illustrated as having specific components or steps, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A latch release system for a vehicle comprising:
- a primary and a secondary latch securing a front hood;
- an emergency handle within a compartment covered by the front hood, linked to the primary latch and movable to actuate a switch;
- a first handle disposed within a cabin of the vehicle, the first handle and the emergency handle are coupled to a common first mechanical link for actuating the primary latch;
- a secondary handle accessible from outside the vehicle with the front hood in a closed position and coupled to the secondary latch through a second mechanical link:
- an actuator arranged to release the secondary latch; and
- a controller configured to trigger the actuator to release the secondary latch responsive to actuation of the switch.

2. The latch release system as recited in claim 1, wherein the common first mechanical link comprises a split Bowden cable including a first end attached to the primary latch, second end attached to the first handle and a third end attached to the emergency handle.

3. The latch release system as recited in claim 1, wherein the secondary latch is releasable only by the actuation through the second mechanical link and the actuator.

4. The latch release system as recited in claim 1, wherein the primary latch releases the front hood only to a partial open position and the secondary latch releases the front hood to allow complete opening of the front hood such that the front hood may be moved to a fully open position only upon release of both the primary latch and the secondary latch.

5. The latch release system as recited in claim 4, wherein controller is configured to not actuate the actuator responsive to actuation of the switch by the release handle when the vehicle speed is outside the predefined threshold range.

6. The latch release system as recited in claim 1, wherein the controller is configured to receive information indicative of vehicle speed and responsive to actuation of the switch by the emergency handle, command the actuator to release secondary latch responsive to the vehicle speed being within a predefined threshold range.

7. The latch release system as recited in claim 6, wherein the predefined threshold range is between 0 and 3 mph.

8. An emergency latch release system for front compartment of a motor vehicle comprising:
- a primary and a secondary latch securing a front hood;
- an emergency handle within the front compartment that is linked to the primary latch by a first mechanical link;

a first handle disposed within a cabin of the vehicle, the first handle and the emergency handle are coupled to a common first mechanical link for actuating the primary latch;

a secondary handle accessible from outside the vehicle with the front hood in a closed position, the secondary handle coupled to the secondary latch through a second mechanical link;

a switch actuatable by the emergency handle;

an actuator commanded by actuation of the switch to release the secondary latch responsive to a vehicle speed being within a predefined threshold range.

9. The emergency latch release system as recited in claim 8, including a controller receiving information indicative of vehicle speed and in communication with the actuator to command release of the secondary latch responsive to the vehicle speed being within the predefined threshold range.

10. The emergency latch release system as recited in claim 8, wherein the emergency handle is actuatable to release only the primary latch through the first mechanical link.

11. The emergency latch release system as recited in claim 10, wherein the secondary latch is releasable from within the front compartment only by actuator.

12. The emergency latch release system as recited in claim 8, wherein the primary latch releases the front hood only to a partial open position and the secondary latch releases the front hood to allow complete opening of the front hood such that the front hood may be moved to a fully open position only upon release of both the primary latch and the secondary latch.

13. A method of securing a front hood of a motor vehicle comprising:

coupling a primary latch to an emergency handle disposed within a compartment covered by a front hood;

coupling a first handle disposed within the cabin of the vehicle and the emergency handle to a common first mechanical link for actuating the primary latch;

coupling a secondary handle accessible from outside of the vehicle when the front hood is in a closed position to a secondary latch through a second mechanical link;

coupling the secondary latch to an actuator;

releasing the primary latch responsive to actuation of the emergency handle; and releasing the secondary latch responsive to actuation of the actuator prompted by a switch within the compartment in response to an indication that a speed of the vehicle is below a threshold speed.

14. The method as recited in claim 13, wherein actuation of both the primary latch and the secondary latch are required to fully open the front hood.

15. The method as recited in claim 13, including opening the front hood to an intermediate position responsive to actuating the emergency handle and the vehicle traveling a speed above the threshold speed, wherein the intermediate position includes release of the primary latch only.

16. The method as recited in claim 13, including a controller receiving information indicative of vehicle speed and controlling actuation of the actuator to release the secondary latch and not releasing the secondary latch responsive to the controller receiving information indicative of a vehicle speed above the threshold speed.

* * * * *